US006563765B1

(12) United States Patent
Ishigaki

(10) Patent No.: US 6,563,765 B1
(45) Date of Patent: May 13, 2003

(54) CLOCK SYSTEM

(75) Inventor: Toshihiro Ishigaki, Kanagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/595,044

(22) Filed: Jun. 15, 2000

(30) Foreign Application Priority Data

Jun. 16, 1999 (JP) ..... 11-169884

(51) Int. Cl.[7] ..... G04C 11/02
(52) U.S. Cl. ..... 368/47
(58) Field of Search ..... 368/10, 46, 47, 368/51, 52; 455/12, 51, 69, 500, 502, 560, 566

(56) References Cited

U.S. PATENT DOCUMENTS 4,014,166 A * 3/1977 Cateora et al. ..... 368/47
4,204,398 A * 5/1980 Lemelson ..... 368/51
4,287,597 A * 9/1981 Paynter et al. ..... 368/47
4,494,211 A * 1/1985 Schwartz ..... 368/47
4,607,257 A * 8/1986 Noguchi ..... 368/46
4,823,328 A * 4/1989 Conklin et al. ..... 368/47
5,323,322 A * 6/1994 Mueller et al. ..... 364/449
5,408,444 A * 4/1995 Kita et al. ..... 368/47
5,621,646 A * 4/1997 Enge et al. ..... 364/449

FOREIGN PATENT DOCUMENTS

JP 10-10251 1/1998

* cited by examiner

*Primary Examiner*—Vit Miska
(74) *Attorney, Agent, or Firm*—RatnerPrestia

(57) ABSTRACT

The clock system corrects the instant time using a signal transmitted from a stationary satellite. In the clock system, a high-frequency-signal transmitted from the stationary satellite is converted to an intermediate-frequency-signal by an analogue-signal-processing-circuit, then converted into a digital signal, and finally decoded to a digital signal by a digital-signal-processing-circuit. A CPU of the system calculates the stationary-satellite-time out of time data included in the signal transmitted, further the CPU converts it to a co-ordinated universal time (UTC). The clock system corrects the time of a clock circuit with the UTC and displays it on a display. As a result, a user of the system at a fixed point on Earth can always receive the time data from the same satellite, so that the clock system can keep time with high accuracy.

16 Claims, 7 Drawing Sheets

CLOCK SYSTEM

FIELD OF THE INVENTION

The present invention generally relates to a clock system which corrects the present time automatically using a time transmitted from a satellite, and more particularly to a clock system which receives signals at a fixed place on Earth always from the same satellite, thereby maintaining the present time with high accuracy.

BACKGROUND OF THE INVENTION

A conventional clock system, which corrects automatically the time using a time data transmitted from a satellite, is disclosed in the Japanese Patent Application Non-Examined Publication No. H10-10251. This is known as an electronic clock system. This electronic clock system receives a high-frequency signal in L1 band (approx. 2 MHz bandwidth on 1575.42 MHz) transmitted from a Global Positioning System (GPS) satellite to the system's antenna. The received high-frequency signal is converted to an intermediate frequency. Then the intermediate frequency signal is multiplied by a code unique to the GPS satellite which is to be locked on, and synchronised with the signal transmitted from the satellite, and the data is thus decoded. Since the decoded data includes the time data, a GPS time (the time when the satellite transmits the signal) is found out of the time data. The coordinated universal time (hereinafter referred to as "UTC") is acquired by converting the GPS time.

A local time of a region, where the clock system is used, can be found from the UTC, because a time difference from the UTC has been stored in a memory, e.g. a ROM. However, this conventional clock system using the GPS satellite has the following problems: Since the GPS satellites are orbiting, a fixed point on Earth is obliged to receive a signal from a different GPS satellite depending on a time slot, therefore, at the local region, a receivable GPS satellite should be predicted, or a plurality of channels are prepared in the receiving system. Further, at a particular place, no GPS satellite can be received depending on the time slot, and thus this place cannot keep accurate time.

SUMMARY OF THE INVENTION

The present invention addresses the problems discussed above and aims to provide a clock system, which receives a signal at a fixed point on Earth always from the same satellite, so that the system can keep time with high accuracy.

The present invention thus concerns a clock system as defined in the appended claims.

This clock system comprises the following elements:

(a) a receiver for receiving a signal transmitted from a stationary satellite;

(b) a calculator for extracting time data from a received signal and calculating the time;

(c) a memory for storing correction information used in converting the stationary satellite time into UTC;

(d) a clock circuit; and (e) a display.

The time of the clock circuit is corrected by the time calculated by the calculator, and then displayed on the display. This structure allows any local fixed place on Earth to receive a time data always from the same satellite, thereby keeping highly accurate time.

DETAILED DESCRIPTION OF PREFERRED EMBODIMENT

Exemplary embodiments of the present invention are demonstrated hereinafter with reference to the accompanying drawings.

(First Exemplary Embodiment)

A clock system disposed at a fixed place on Earth receives a highly accurate time-data from a stationary satellite and corrects its local time using this time-data, so that the local time is maintained with high accuracy.

Figure 1:
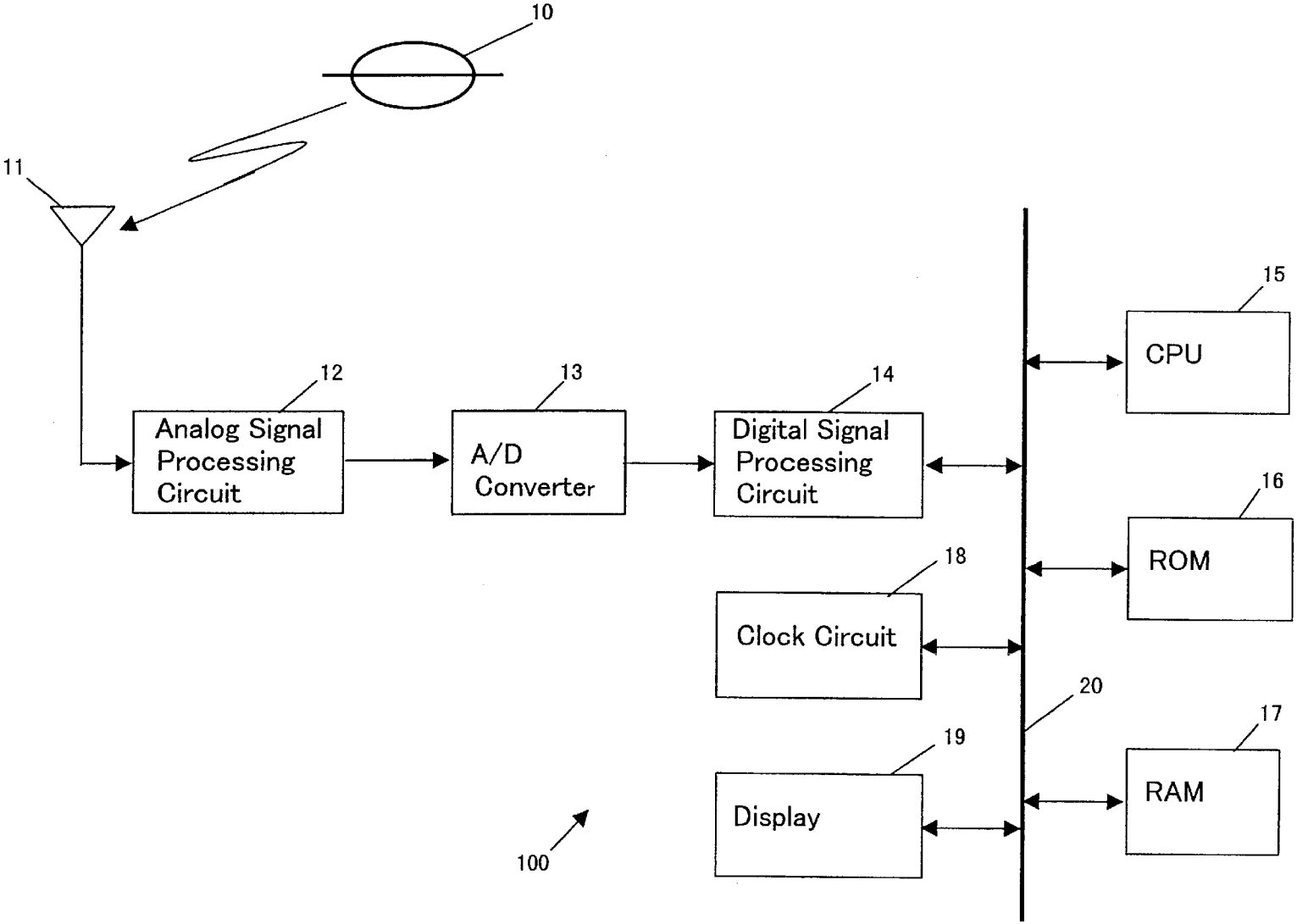
FIG. 1 is a block diagram illustrating a structure of a clock system in accordance with a first exemplary embodiment of the present invention.

FIG. 1 is a block diagram illustrating a structure of clock system 100 in accordance with the first exemplary embodiment of the present invention.

Antenna 11 is used for receiving a signal from stationary satellite 10 which belongs to the GPS wide-area-assisting system (referred to as MASA in Japan, WAAS in the US, and EGNDS in Europe) and installed outside a building or on an outer wall of a house. A signal received by antenna 11—a high-frequency signal of 1575.42 MHz that is the same as the frequency of a signal received by the GPS antenna—is fed into analogue-signal-processing-circuit 12 and the high frequency is converted to an intermediate frequency.

The signal converted to the intermediate frequency is then converted to a digital signal by A/D converter 13. This digital signal is multiplied by a code unique to stationary satellite 10 in digital-signal-processing-circuit 14 so that the signal is synchronised with the signal from satellite 10, thereby decoding the signal received from satellite 10 and acquiring the data. Since the data transmitted from satellite 10 includes a time data, CPU 15 works on the time data included in the decoded signal and figures out, i.e. extracts and calculates the stationary satellite time.

ROM 16 stores an operational program of clock system 100, correction information for converting the stationary satellite time to the UTC, and time difference data between a local time of the region where the clock system 100 is used and UTC. CPU 15 converts the stationary-satellite-time into the UTC and finds the local time using these materials. CPU 15 uses RAM 17 as a working area for these calculations. The time of clock circuit 18 is corrected with this resultant time and displayed on display 19.

Circuit 14, CPU 15, ROM 16, RAM 17, clock circuit 18 and display 19 are coupled by internal BUS 20.

An atomic clock is installed in stationary satellite 10, and its error data is also transmitted together with the time data. Therefore, clock system 100 can acquire the time with high accuracy. The stationary-satellite-time arrives at clock system 100 with a travelling time delay. This travelling time varies within a range from approx. 120 ms to approx. 140 ms depending on the distance between clock system 100 and the satellite. The travelling time can be found with a precision of several-hundred nanoseconds if the position of clock system 100 is known. Even if the position of clock system 100 is not known, the travelling time is corrected with an average of the travelling time, so that the travelling time is found with a precision of ±10 ms.

A leap second is corrected in the following way: After the time of 23:59' 59" of the UTC, a leap second, i.e. 23:59'60", is inserted and then the time reaches 0:0'0". However, display 19 cannot indicate 60", and therefore, repeats either 23:59'59" or 0:0'0" twice. If 0:0'0" is repeated twice, a difference of one second occurs in the year-month-date system. Thus the present invention allows display 19 to indicate 60" and display 23:59'60" when the leap second is inserted. This control program has been stored in ROM 16, so that CPU 15 does not display 60" regularly but displays 60" only when the leap second is corrected.

The clock system of the present invention receives time data with high accuracy from the stationary satellite and corrects its own local time. In other words, a place fixed on Earth can always receive a signal from the same stationary satellite, so that the clock system disposed at the place can keep time with high accuracy. Further, in the case of a leap second correction, the display indicates the leap second free from an error in the year-month-date system, so that a one-second difference in the year-month-date system can be avoided.

(Second Exemplary Embodiment)

In the second exemplary embodiment, a satellite-number-assigning-circuit is provided so that a user can assign a stationary satellite to be locked onto.

Figure 2:
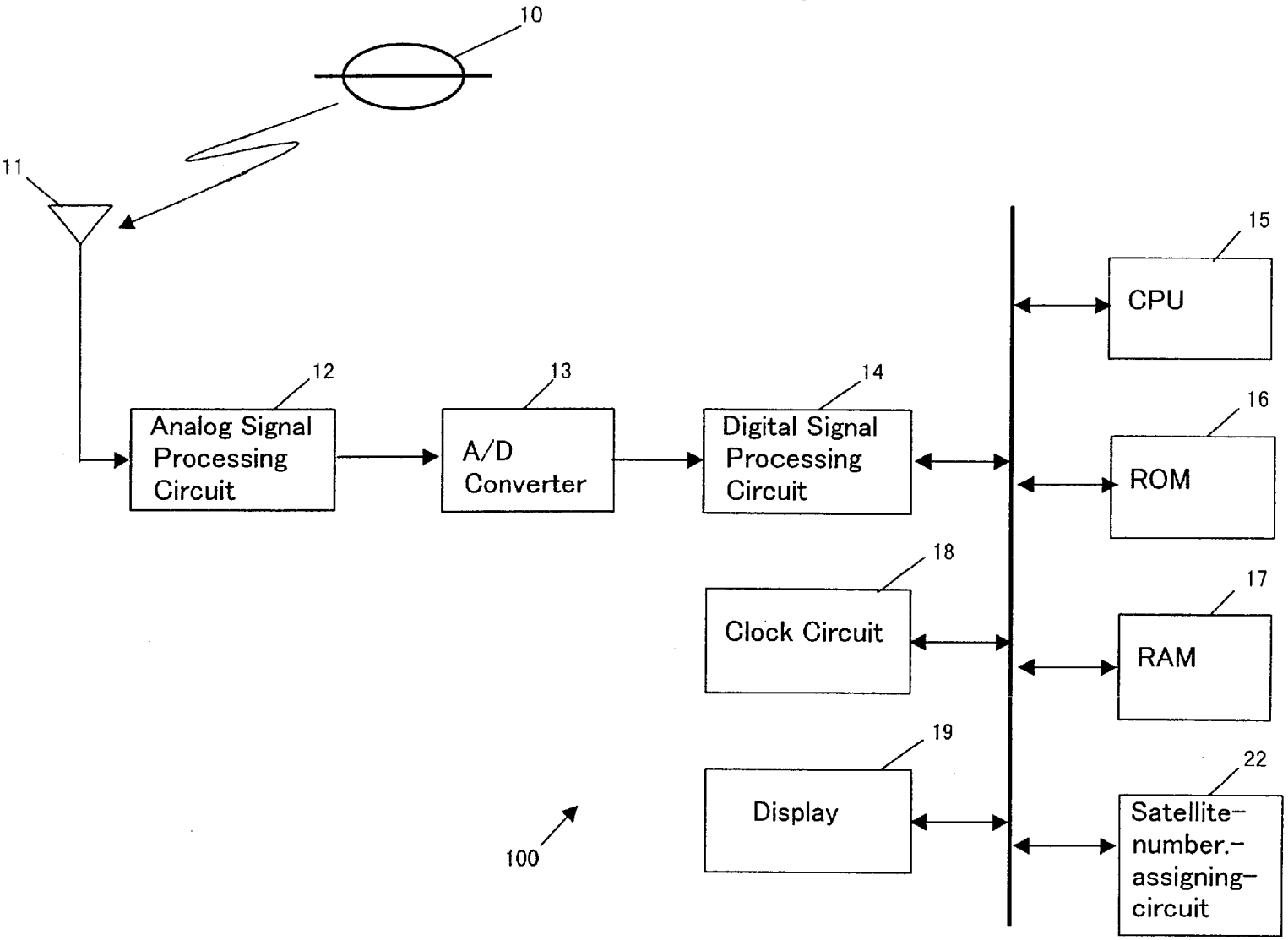
FIG. 2 is a block diagram illustrating a structure of a clock system in accordance with a second exemplary embodiment of the present invention.

FIG. 2 is a block diagram illustrating clock system 100 in accordance with the second embodiment. In this embodiment, the same sections already shown in FIG. 1 bear the same reference marks, and the descriptions thereof are thus omitted here.

This clock system 100 has satellite-number-assigning-circuit 22 in addition to clock system 100 shown in FIG. 1. ROM 16 stores codes corresponding to satellites' numbers and unique to the respective satellites. Circuit 22 comprises switches, etc. and is coupled to CPU 15 via internal BUS 20. The satellite's number is assigned to stationary satellite 10 independently, and CPU 15 identifies the number assigned by circuit 22 and searches stationary satellite 10 corresponding to that number.

In clock system 100 as structured above, a signal received by antenna 11 is converted into an intermediate frequency signal in analogue-signal-processing-circuit 12, then runs to CPU 15 through A/D converter 13 and digital-signal-processing-circuit 14. This is the same process as discussed in the first embodiment.

CPU 15 identifies the number assigned to satellite 15 by circuit 22, then reads out a code—corresponding to this number and also unique to the satellite—from ROM 16, then outputs it to digital-signal-processing-circuit 14. In circuit 14, the intermediate-frequency-signal is multiplied by the code. unique to the stationary satellite, so that the intermediate-frequency-signal is synchronised with the signal from satellite 10. Then satellite 10 corresponding to the number is locked onto, and the data is acquired. The data is supplied to the CPU and undergoes the same process as in the first embodiment.

This second embodiment proves that a user can assign a stationary satellite from which the user desirably receives a time data. Therefore, even in a place where a plurality of receivable stationary satellites is available, a user can assign a desirable satellite among them, and acquires the time data always from this satellite. When the number is changed because the satellite is discontinued due to its service-life-end or a new stationary satellite is launched, it is thus easy to deal with this change.

(Third Exemplary Embodiment)

In the third exemplary embodiment, an interface for an external input is provided so that a region can be specified through an external input. Further, a local time is calculated, a delay due to travelling of a signal is corrected, and a daylight-saving time can be displayed.

Figure 3:
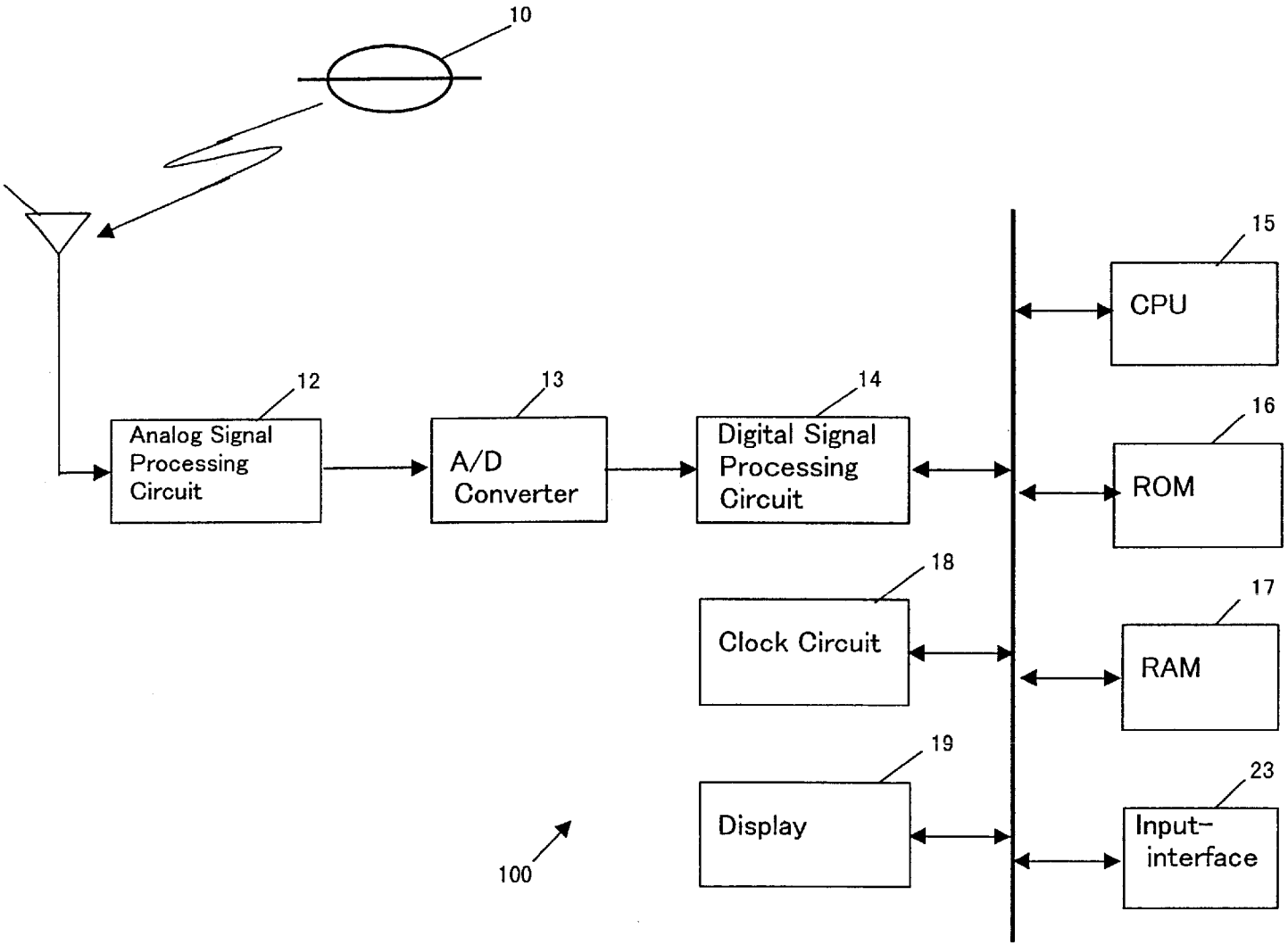
FIG. 3 is a block diagram illustrating a structure of a clock system in accordance with a third exemplary embodiment of the present invention.

FIG. 3 is a block diagram illustrating clock system 100 in accordance with the third exemplary embodiment. The same sections already shown in FIG. 1 bear the same reference marks.

This clock system 100 has input-interface 23 in addition to clock system 100 shown in FIG. 1. Input-interface 23 is coupled to CPU 15 through internal BUS 20, and is used for introducing the region where clock system 100 is used. ROM 16 or RAM 17 stores the following information.

(a) time difference data between the UTC and local times of respective regions;

(b) an average travelling time from stationary satellite 10 to each region; and (c) daylight-saving time information in each region.

The receivable stationary satellite depends on each region, and digital-signal-processing-circuit 14 thus prepares a plurality of channels. One channel out of the other channels always searches all the stationary satellites, and the other channels search respective satellites independently, so that some receivable satellites can be found. Then one of the receivable satellites is selected.

In clock system 100 as structured above, a signal received by antenna 11 is converted into an intermediate frequency signal in analogue-signal-processing-circuit 12, then runs to A/D converter 13 and digital-signal-processing-circuit 14. Finally the data is acquired. This is basically the same process as discussed in the first embodiment.

CPU 15 finds a time difference with the region where clock system 100 is used and figures out a local time, using the time data supplied from circuit 14, the information of the region specified by input-interface 23, and time difference data. At this time, an average travelling time data in this region is read out from ROM 16 or RAM 17 and is used for calculating the local time. Further, the year-month-date and the day of the week calculated by CPU 15 are compared with the daylight-saving time information stored in ROM 16 or RAM 17 for determining whether or not the instant time falls within the daylight-saving time period. If the instant time is within the daylight-saving time period, one hour should be added. The resultant year-month-date and time are displayed on display 19.

The third embodiment as discussed above demonstrates that specifying a region allows the clock system to correct the local time. Therefore, the local time can be displayed without knowing the time difference between the UTC and the region. The average travelling time for each region is used for the correction, so that a more accurate local time can be acquired. Further, year-month-date and the day of the week are displayed, so that the clock system can be used as a calendar. During the daylight-saving time, the time is appropriately displayed.

In this third embodiment, digital-signal-processing-circuit 14 prepares a plurality of channels, and thus when one of the stationary satellites has a problem, another satellite can be used for acquiring highly accurate time. As a result, a more reliable clock system 100 can be provided.

When clock system 100 receives a new signal from a newly launched stationary satellite, or a signal on an unspecified channel from a stationary satellite, the channel is newly specified to start receiving the signals from the satellite.

(Fourth Exemplary Embodiment)

In the fourth exemplary embodiment, a CPU handles interruptions requested by a timer periodically, so that the clock system of the present invention can receive time data from the satellite intermittently.

Figure 4:
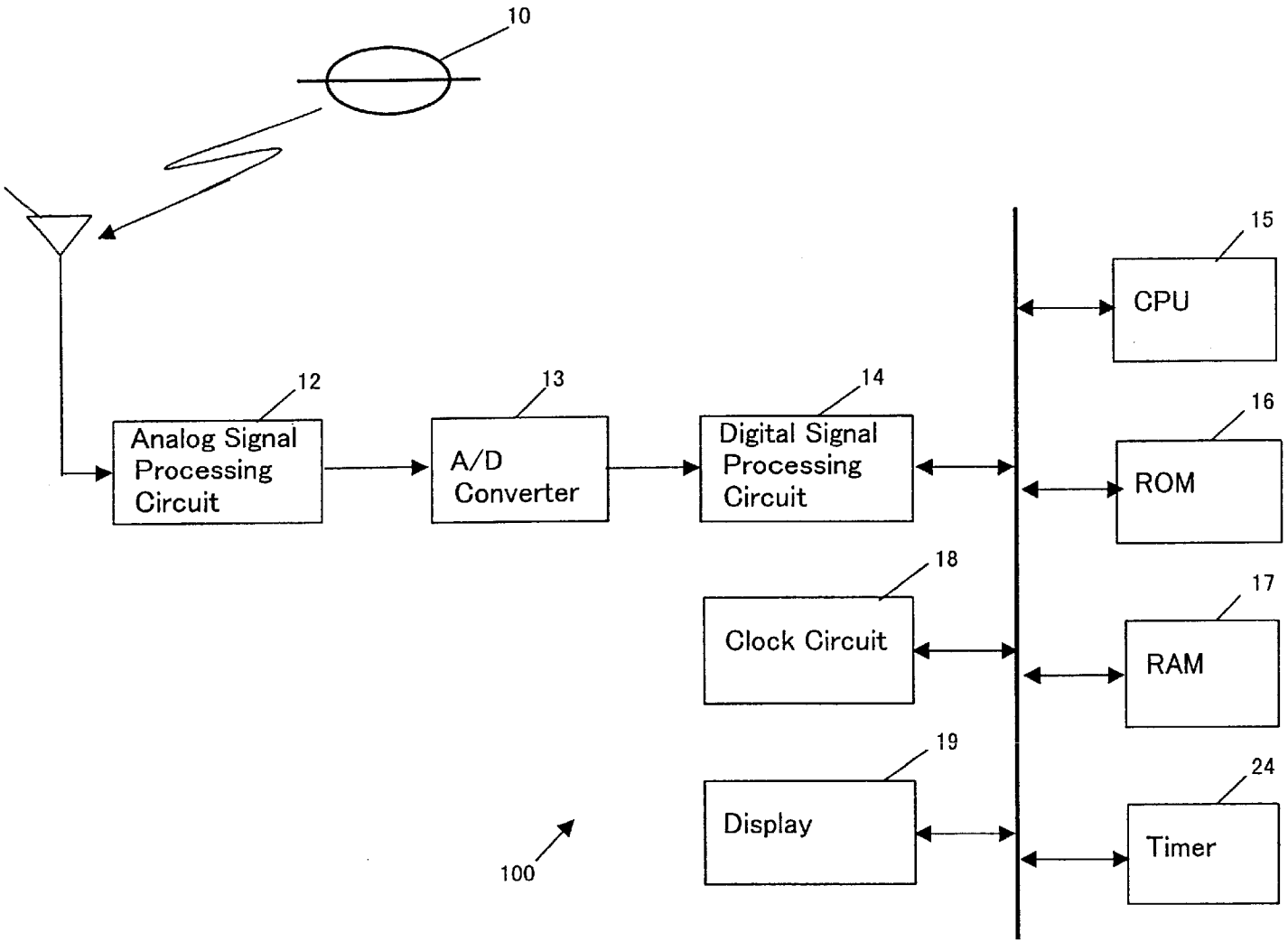
FIG. 4 is a block diagram illustrating a structure of a clock system in accordance with a fourth exemplary embodiment of the present invention.

FIG. 4 is a block diagram illustrating a structure of clock system 100 in accordance with the fourth embodiment. In FIG. 4, the same sections already shown in FIG. 1 bear the same reference marks used in FIG. 1.

This clock system 100 has timer 24 in addition to clock system 100 shown in FIG. 1. Timer 24 is coupled to CPU 15 through internal BUS 20, and issues interrupting triggers at given intervals to the computation process of CPU 15.

Clock system 100 in accordance with this fourth embodiment comprises clock circuit 18, display 19 and timer 24, and only these three elements operate continuously while other elements may be halted.

When timer 24 issues a trigger signal at a given time, CPU 15 receives the trigger signal and then activates antenna 11, analogue-signal-processing-circuit 12, A/D converter 13 and digital-signal-processing-circuit 14. A signal from a stationary satellite is received by antenna 11, then converted to an intermediate-frequency-signal at analogue-signal-processing-circuit 12. The signal runs to A/D converter 13 and to digital-signal-processing-circuit 14, where the data is acquired. The acquired data is then supplied to CPU 15. CPU 15 figures out a satellite time using the data, and then corrects the instant time of clock circuit 18. Finally, CPU 15 halts the operation of circuit 12, of converter 13 and of circuit 14.

CPU 15 stores a correction amount and a corrected instant time of clock circuit 18 into RAM 17, and calculates the accuracy of clock circuit 18. CPU 15 then calculates backward the timings for correcting the time based on the accuracy of clock circuit 18. For instance, clock circuit 18 has an error of one minute per day, and if a user wants to reduce the error to not more than 15 seconds, the user sets timer 24 to issue a trigger signal every six hours.

As discussed above, the fourth embodiment allows antenna 11, analogue-signal-processing-circuit 12, A/D converter 13 and digital-signal-processing-circuit 14 to halt during regular operation of clock system 100, and timer 24 to receive signals from stationary satellite 10 intermittently, so that clock system 100 consumes less power. As a result, a battery can be used as a power source. Further, the clock system measures the accuracy of clock circuit 18 during its operation, and sets intervals of issuing interruptions responsive to an accuracy of clock circuit 18 requested by a user, so that the receiving intervals can be adjusted. As a result, the power consumption by clock system 100 can be minimised.

(Fifth Exemplary Embodiment)

In the fifth exemplary embodiment, depressing a button prompts a clock system to start receiving signals from a stationary satellite, and then the time is calculated.

Figure 5:
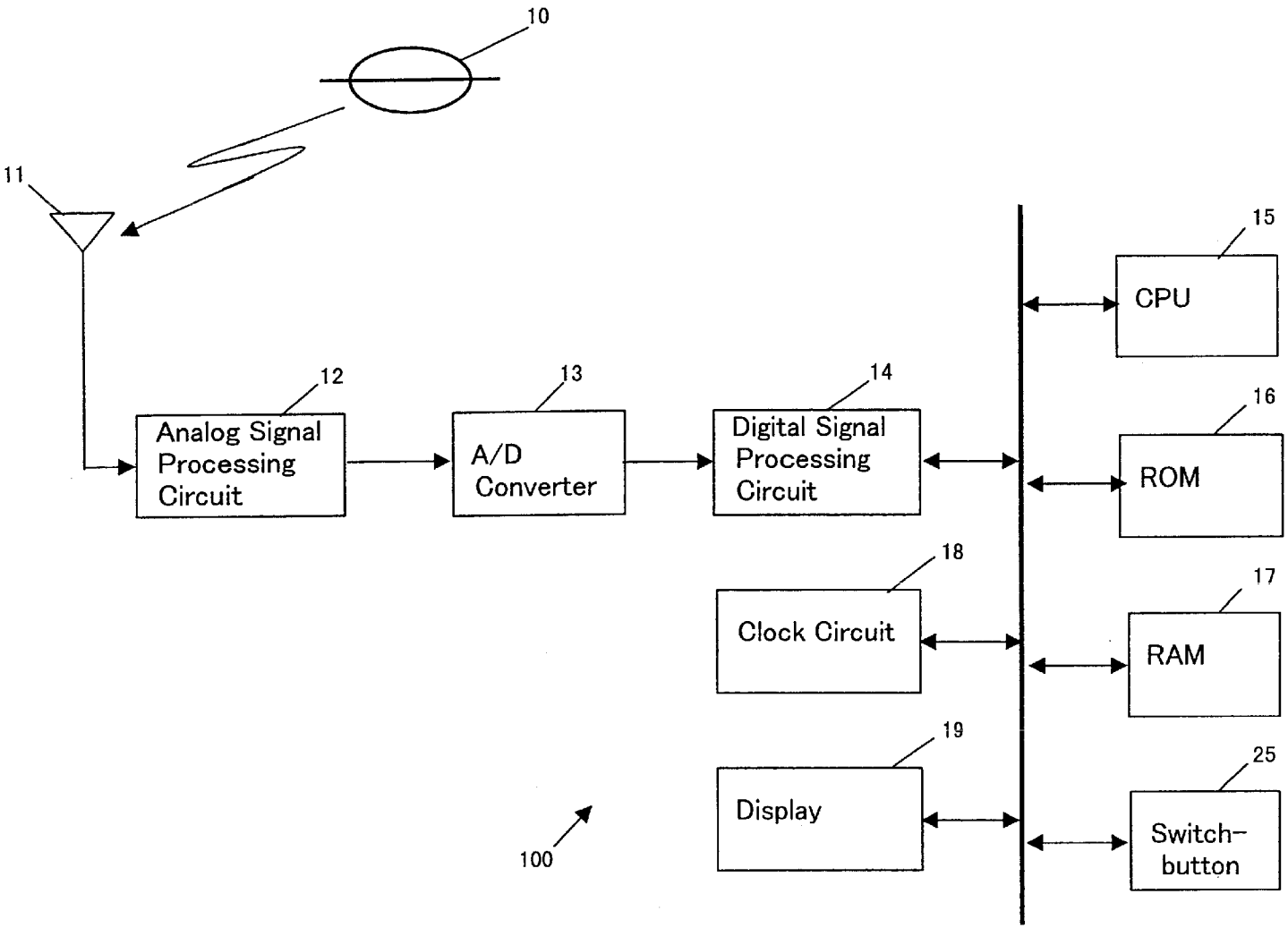
FIG. 5 is a block diagram illustrating a structure of a clock system in accordance with a fifth exemplary embodiment of the present invention.

FIG. 5 is a block diagram illustrating a structure of clock system 100 in accordance with the fifth embodiment. In FIG. 5, the same sections already shown in FIG. 1 bear the same reference marks used in FIG. 1.

This clock system 100 has a switch-button 25 in addition to clock system 100 shown in FIG. 1. Switch-button 25 is coupled to CPU 15 through internal BUS 20, and depressing switch-button 25 activates CPU 15.

When detecting a depression of switch-button 25, CPU 15 activates antenna 11, analogue-signal-processing-circuit 12, A/D converter 13 and digital-signal-processing-circuit 14. A signal from a stationary satellite is received by antenna 11, then converted to an intermediate-frequency-signal at analogue-signal-processing-circuit 12. The signal runs to A/D converter 13 and digital-signal-processing-circuit 14, where the data is acquired. The acquired data is then supplied to CPU 15. CPU 15 calculates the time using the data, and then corrects the time of clock circuit 18. Finally, CPU 15 halts the operation of circuit 12, of converter 13 and of circuit 14.

As discussed above, the fifth embodiment proves that depressing switch-button 25 prompts clock system 100 to start receiving signals from stationary satellite 10, therefore, the timing for correcting the time can be determined manually. This is convenient for a portable clock system, which may thus be operated only when stationary satellite 10 is receivable.

(Sixth Exemplary Embodiment)

In the sixth exemplary embodiment, external output interface 25 is provided so that a clock circuit disposed outside the clock system can be corrected.

Figure 6:
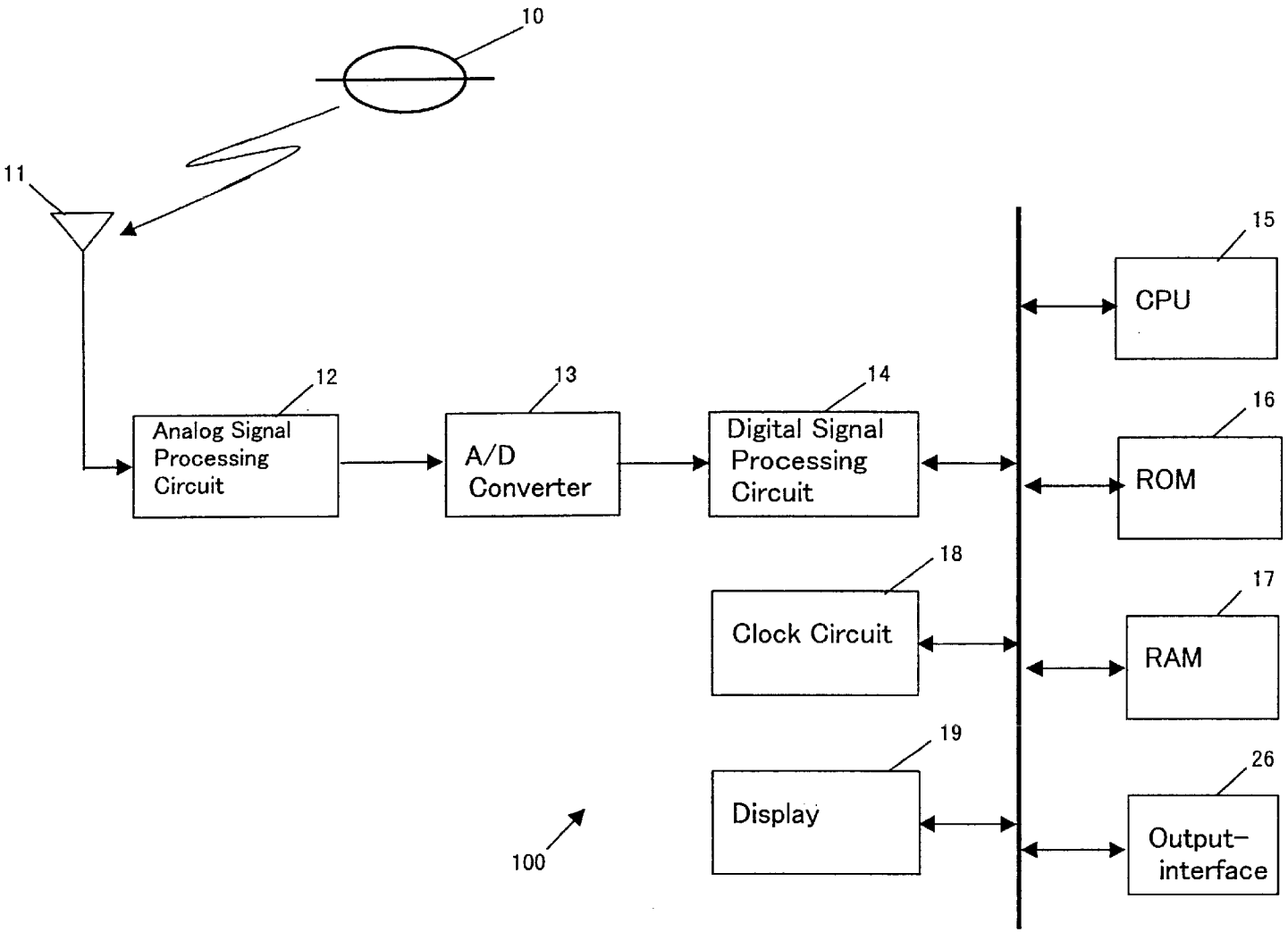
FIG. 6 is a block diagram illustrating a structure of a clock system in accordance with a sixth exemplary embodiment of the present invention.

FIG. 6 is a block diagram illustrating a structure of clock system 100 in accordance with the sixth embodiment. In FIG. 6, the same sections already shown in FIG. 1 bear the same reference marks used in FIG. 1.

This clock system 100 has output interface 26 in addition to clock system 100 shown in FIG. 1. Output interface 26 is coupled to CPU 15 through internal BUS 20, and outputs the time figured out by CPU 15.

A signal from a stationary satellite is received by antenna 11, then converted to an intermediate-frequency-signal at analogue-signal-processing-circuit 12. The signal runs to A/D converter 13 and digital-signal-processing-circuit 14, where the data is acquired. The acquired data is then supplied to CPU 15. CPU 15 calculates the time using the data. These are the same processes as discussed in the first embodiment.

The time figured out by CPU 15 is supplied to an external device through output-interface 26. This highly accurate time can be utilised for correcting a timer or a clock of the external device.

The sixth embodiment as discussed above outputs the accurate time—found by receiving a signal from a stationary satellite—to an external device, so that a timer or a clock of the external device can be corrected. This embodiment can be utilised for correcting the time of a timer or a clock incorporated in home appliances such as a VCR, personal computer, rice cooker and the like.

(Seventh Exemplary Embodiment)

In the seventh exemplary embodiment, one-second pulse generating circuit 26 is provided to the clock system shown in FIG. 6, so that time with high accuracy can be acquired when an output time data is latched with a one-second pulse.

Figure 7:
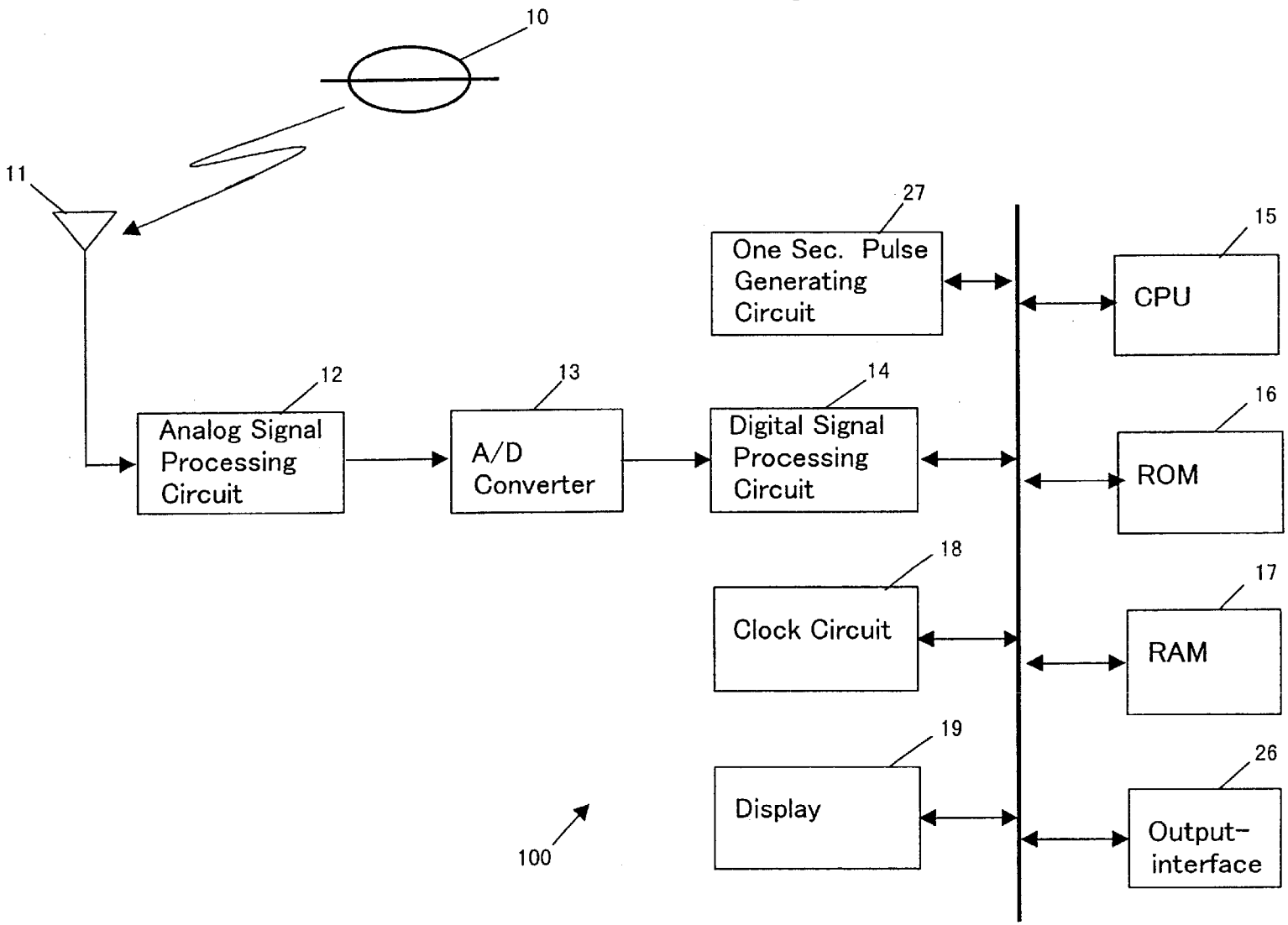
FIG. 7 is a block diagram illustrating a structure of a clock system in accordance with a seventh exemplary embodiment of the present invention.

FIG. 7 is a block diagram illustrating a structure of clock system 100 in accordance with the seventh embodiment. In FIG. 7, the same sections already shown in FIG. 6 bear the same reference marks used in FIG. 6.

One-second pulse generating circuit 27 is coupled to CPU 15 through internal BUS 20. When figuring out the time, CPU 15 controls the generation of the one-second pulse by synchronising this pulse with a control signal from the CPU.

A signal from a stationary satellite is received by antenna 11, then converted to an intermediate-frequency-signal at analogue-signal-processing-circuit 12. The signal runs to A/D converter 13 and digital-signal-processing-circuit 14, where the data is acquired. The acquired data is then supplied to CPU 15. CPU 15 calculates the time using the data, and outputs the data to an external device. These are the same processes as discussed in the sixth embodiment.

When calculating the time, CPU 15 thus controls the one-second-pulse generation in one-second pulse generating circuit 27. Circuit 27 issues a one-second pulse just when a fractional value less than a second is reduced to zero (0). This one-second pulse is supplied together with the time figured out by CPU 15 to the external device through output-interface 26 for synchronising the time of the external device. In this case, CPU 15 always adds one second to the time data, thereby outputting the time data in phase with the fall of the one-second pulse, or CPU 15 outputs the time data in advance of normal time by approx. 0.5 seconds considering a delay due to transfer to the external device. As a result, when the time data is latched with the one-second pulse, the exact time can be acquired.

What is claimed is:

1. A clock system comprising:

(a) stationary receiving means for receiving a signal originating from a stationary satellite belonging to a GPS wide-area-assisting system;

(b) calculating means for extracting time data from the received signal, and calculating a satellite time;

(c) clock means for providing a counted time;

(d) display means for displaying an adjusted time; and (e) a satellite-number-assignment-circuit for assigning a number unique to the stationary satellite, wherein said system receives a signal from the stationary satellite assigned by said assigning circuit;

wherein said system adjusts the counted time with the satellite time for determining the adjusted time.

2. The clock system as defined in claim 1, wherein said receiving means comprises:

(a-1) a first signal-processing-circuit for receiving a signal transmitted from said satellite and converting the signal to an intermediate-frequency signal; and (a-2) a second signal-processing-circuit for decoding the intermediate-frequency signal into satellite data;

and wherein said calculator means calculates the satellite-time based on time data included in the satellite data, and converts the satellite-time into a coordinated universal time (UTC) so that said system corrects the time of said clock circuit based on the calculated UTC.

3. The clock system as defined in claim 1 further comprising a memory for storing a time difference data between the UTC and a local time of a place on Earth, wherein said system calculates the local time using the UTC calculated by said calculating means and the time difference data.

4. The clock system as defined in claim 1 further comprising a memory for storing an average travelling time from said stationary satellite to a local place on Earth, wherein said system corrects an error due to travelling delay by using the UTC calculated by said calculating means and the average travelling time.

5. The clock system as defined in claim 1 wherein said calculating means figures out the year-month-date and the day of the week in addition to the UTC.

6. The clock system as defined in claim 4 wherein said memory or stores daylight-saving time information of a local place, and said calculating means compares the calculated UTC with the daylight-saving time information for correcting the UTC calculated into daylight-saving time during a daylight-saving time period.

7. The clock system as defined in claim 2, wherein said second signal-processing-circuit has a plurality of channels.

8. The clock system as defined in claim 7, wherein one channel of said plurality of channels searches every stationary satellite, and when said one channel receives a transmission signal from a stationary satellite not yet assigned, said system newly assigns a receiving channel for this satellite.

9. The clock system as defined in claim 1 further comprising a timer, wherein said system periodically receives a signal from the stationary satellite according to a set-time designated by said timer.

10. The clock system as defined in claim 9, wherein said system measures the accuracy of said clock circuit in operation, and adjusts said set-time of said timer responsive to the accuracy.

11. The clock system as defined in claim 1 further comprising a switch-button for activating the reception of the signal from the stationary satellite, wherein when said button is operated, said system receives the signal from the stationary satellite.

12. The clock system as defined in claim 1 further comprising an output interface for outputting the calculated corrected time to an external device.

13. The clock system as defined in claim 1 further comprising a one-second-pulse-generating circuit for generating a one-second pulse synchronising with the corrected time, wherein said system outputs the corrected time together with the one-second pulse to an external device.

14. The clock system as defined in claim 13 wherein said system outputs the corrected time in advance of normal time by approximately 0.5 seconds.

15. The clock system as defined in claim 1 wherein said display indicates a time when a leap second is inserted.

16. A clock system comprising:

(a) stationary receiving means for receiving a signal originating only from a predetermined stationary satellite belonging to a GPS wide-area-assisting system;

(b) calculating means for extracting time data from the received signal, and calculating a satellite time;

(c) clock means for providing a counted time; and (d) display means for displaying an adjusted time;

wherein said system adjusts the counted time with the satellite time for determining the adjusted time.

* * * * *